United States Patent [19]

Straubel et al.

[11] Patent Number: 4,538,580

[45] Date of Patent: Sep. 3, 1985

[54] FUEL INJECTION PUMP

[75] Inventors: Max Straubel, Stuttgart; Hermann Eisele, Vaihingen, both of Fed. Rep. of Germany; Jean Leblanc, Lyons; Jean Pigeroulet, Villeurbanne, both of France

[73] Assignee: Robert Bosch GmbH, Stuttgart, Fed. Rep. of Germany

[21] Appl. No.: 543,660

[22] Filed: Oct. 19, 1983

[30] Foreign Application Priority Data

Nov. 24, 1982 [DE] Fed. Rep. of Germany ..... 3243348

[51] Int. Cl.[3] ..... F02M 59/34

[52] U.S. Cl. ..... 123/494; 123/357; 123/450; 123/458

[58] Field of Search ..... 123/357, 458, 494, 358, 123/359, 500, 501, 450

[56] References Cited

U.S. PATENT DOCUMENTS

| | | | |
|---|---|---|---|
| 4,378,775 | 4/1983 | Straubel | 123/458 |
| 4,398,519 | 8/1983 | Tissot | 123/449 |
| 4,406,263 | 9/1983 | Leblanc | 123/449 |

FOREIGN PATENT DOCUMENTS

| | | | |
|---|---|---|---|
| 1919969 | 11/1970 | Fed. Rep. of Germany | 123/458 |
| 1919707 | 11/1970 | Fed. Rep. of Germany | 123/458 |
| 3017276 | 11/1981 | Fed. Rep. of Germany | 123/450 |
| 1306422 | 2/1973 | United Kingdom | 123/458 |
| 2076075 | 11/1981 | United Kingdom | 123/450 |

*Primary Examiner*—Carl Stuart Miller

*Attorney, Agent, or Firm*—Edwin E. Greigg

[57] ABSTRACT

A fuel injection pump for internal combustion engines in which by means of an obliquely extending control groove on the jacket face of a distributor, the end of injection can be varied by opening a relief conduit during the displacement of the distributor. The injection onset is made to follow this variable end of injection by providing that the stroke position of the pump pistons of the fuel injection pump is ascertained at the end of injection by a transducer, by means of which at the same time a metering duration of a magnetic valve that has already been opened at the time of the end of the injection stroke is controlled. In this manner, with a radial piston pump so embodied, the opportunity is afforded of accurately adjusting the quantity of fuel to be metered by means of a magnetic valve, even with variable injection times. All that needs to be done is that the magnetic valve be closed exactly and rapidly at the end of metering, while an error in opening on the part of the magnetic valve does not occur. In this manner, a very precise metering of the fuel to be injected is attained with simple means.

15 Claims, 8 Drawing Figures

FUEL INJECTION PUMP

BACKGROUND OF THE INVENTION

The invention is base on a fuel injection pump for an internal combustion engine. In a known fuel injection pump of this type (German Offenlegungsschrift No. 30 17 276), the control groove is disposed obliquely in the jacked face with respect to the axis of the distributor, so that upon a displacement of the distributor the onset of filling or the end of injection during the injection stroke can be varied. To control the quantity injected, a pre-storage reservoir of variable volume is provided, from which the fuel is delivered to the pump work chamber during the intake stroke controlled by the control groove. The adjusting mechanisms for the variable reservoir plus an additional electrical adjusting device represents considerable expenditure for this form of embodiment. Futhermore, an additional expense must be undergone for controlling the supply of the pre-storage reservoir in cycles synchronized with the pump rpm.

In an injection device known from German Offenlengungsschrift No. 19 19 969, the fuel quantity which is supposed to be injected during the supply stroke of the pump piston of an injection pump is metered in a simplified manner upon the intake stroke of the pump piston by means of a magnetic valve controlled in a clocked or an analog manner. A pre-storage reservoir is thus unnecessary. The metering quantity is determined by the opening time of the magnetic valve, and the opening phase of this valve takes place solely within the time period in which the intake stroke of the pump piston occurs. In this known device, pressure conditions in the work chamber and the valve cross section of the fuel injection pump affect the metering quantity. For precise metering of the fuel injection quantity, the rpm and the instant of injection must be taken into consideration when designing the duration of opening of the magnetic valve. Pressure fluctuations in the work chamber during the filling process must also be taken into consideration. Further disadvantages of the known device are a result of the limited switching speed of a magnetic valve. The two switching events of the magnetic valve which take place during the metering phase during the intake stroke thus affect the precision of the result of metering. Furthermore, limits are placed upon the rpm or the pump rpm by the switching time of the magnetic valve.

In another fuel injection pump, known from German Offenlegungsschrift No. 19 19 707, the limited switching speed of magnetic valves was taken into account by providing, in this distributor injection pump, that two pump systems are accommodated in the distributor, each being supplied with fuel via one magnetic valve. In this manner, a high pump rpm is attainable. Furthermore, in this injection pump the cam drive of the pump pistons is embodied such that the stroke speed of the pump piston is substantially less during the intake stroke than during the supply stroke. The magnatic valve of each pump system of this radial piston pump is in any case opened solely during the intake stroke of the pump piston, and the opening duration of the magnetic valve determines the metering. Here again, the rpm and the adjustment of the instant of injection must be taken into consideration in controlling the magnetic valves. In the design of this pump, the metering cycle of the magnetic valve begins with the intake stroke of the associated pump piston. An adjustment of the injection onset necessitates a change in the onset of the intake stroke, so that the latter must be stated precisely when calculating the opening time of the magnetic valve. In so doing, however, the dynamic conditions prevailing at the reversal point of the pump piston during the transition from the supply stroke to the intake stroke are very difficult to control.

OBJECT AND SUMMARY OF THE INVENTION

The fuel injection apparatus according to the invention has the advantage over the prior art that the supply phase, that is, the period of time during which fuel is pumped into the injection lines, is followed by a scavenging phase. In this scavenging phase, which also encompasses the remaining compression stroke of the pump piston, the pump work chamber is continuously filled with fuel via the electrically actuatable valve and, if needed, via the relief line. At the instant of the onset of the metering of fuel into the pump work chamber during the intake stroke of the pump piston, balanced pressure conditions thus prevail, so that with a sufficiently large metering cross section at the valve, the opening period of the valve with respect to the rpm or the opening phase over a predetermined length of pump piston intake stroke is a precise standard for the fuel injection quantity. Since during the scavenging period, for instance following the supply stroke of the pump piston, the electrically actuatable metering valve is already opened, the only factor now affecting the precision of the result of metering is the closing time of the magnetic valve. Only this closing time needs to be controlled precisely. With the provision according to the invention, the further opportunity is also provided, in a fuel injection pump of the general type described at the outset above, of compensating in a simple manner for the varying conditions existing at variable instants of injection.

The invention will be better understood and further objects and advantages will become more apparent from the ensuing detailed description of preferred embodiments taken in conjunction with the drawings.

DESCRIPTION OF THE PREFERRED EMBODIMENTS

Figure 1:
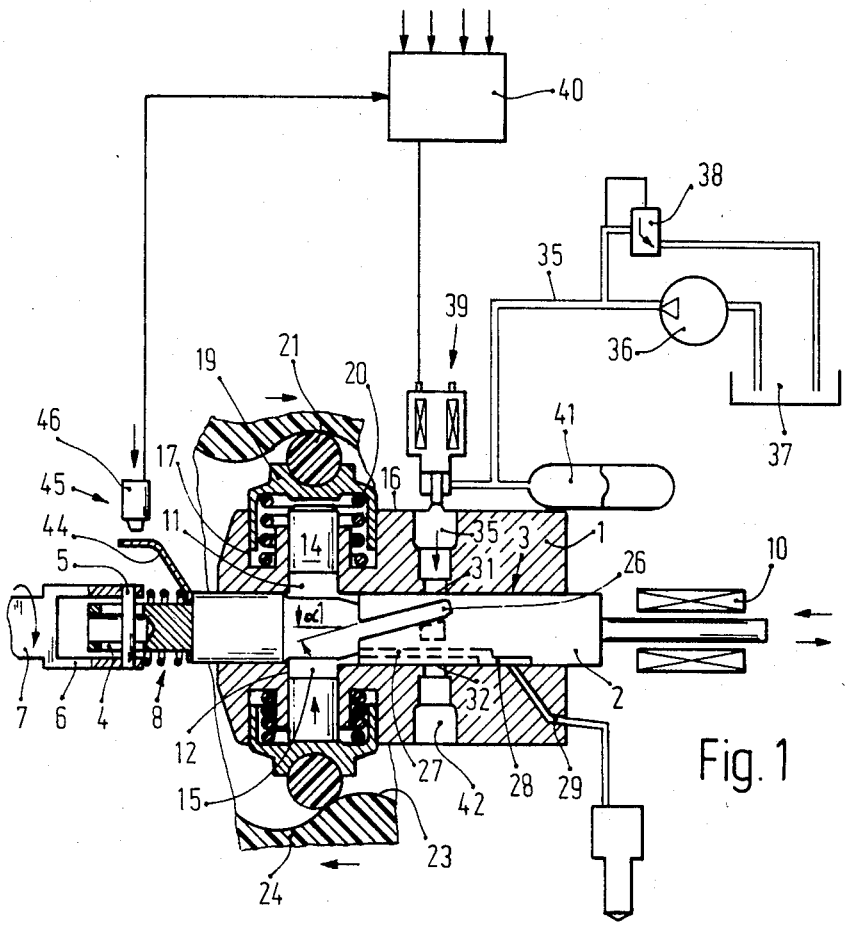
FIG. 1 shows a first exemplary embodiment of a fuel injection pump according to the invention in longitudinal section.

In a cylindrical housing 1 of a fuel injection pump, a distributor 2 is supported in a bore 3 such that it is displaceable and rotatable. At one end, the distributor 2 has an oblong slot 4, which extends axially parallel and through which a bolt 5 is guided, which is firmly connected with a fork-like end 6 of a drive shaft of the fuel injection pump. By means of the bolt 5, the distributor 2 is firmly coupled in the direction of rotation with the drive shaft 7, while in contrast the distributor 2 is capable of executing movements relative to the drive shaft 7 in the longitudinal direction. A compression spring 8 is also disposed between the drive shaft 7 and the distributor 2 and tends to urge the distributor into a preferred position, for instance a position corresponding to the latest possible instant of injection. An adjusting force generated by a magnet winding 10 preferably engages the opposite end of the distributor 2, counter to the force of the compression spring 8, by means of which adjusting force the distributor 2 can be held in any desired longitudinal adjusting position because of the slot 4 in the opposite end. In the vicinity of the bore 3, the distributor 2 also has an annular groove 11, in the vicinity of which radial bores 12 in the housing extend from the bore 3; pump pistons 14 are supported such that they are tightly displaceable in the radial bores 12. The annular groove 11 remains in continuous, unthrottled communication with the radial bores 12, independently of the displaced position of the distributor 2, and together with the chamber enclosed toward the distributor by the pump piston 14 defines a pump work chamber 15.

Coaxially with the bores 12 and the pump pistons 14, guide bores 17 are provided, extending in the cylindrical housing 1 from its outer jacket face 16; the guide bores 17 are in the form of blind bores in which are guided tappet cups 19, which are stressed by restoring spring 20 supported on the bottom of the guide bores 17. The outer surface of the tappet cups 19 is embodied as a bearing location for guide rollers 21, which under the influence of the restoring spring 20 are held via the tappet cups 19 on a cam path 23. This cam path 23 is located on a coaxial cam ring radially surrounding the cylindrical housing 16; the cam ring, not shown, is driven simultaneously with the drive shaft 7.

Since the guide rollers are held between the cam path 23 and the tappet cup 19 under the influence of the restoring springs 20, the bearing of the rollers on the tappet cup can be embodied as an open bearing location, without requiring means for gripping the guide rollers for safety's sake. The stress on the rollers is also kept low as the result of the continuous contact with the cam path 23.

Branching off from the annular groove 11 on the jacket face of the distributor 2 is a control groove 26 extending obliquely at the angle $\alpha_1$ from the axis of the distributor, which is in continuous communication with the annular groove 11. The annular groove 11 and the work chamber 15 also communicates continuously, via a longitudinal conduit 27, with a distributor groove 28 on the jacket face of the distributor.

Within the range of movement of the distributor groove 28, injection lines 29 discharge into the bore 3 in accordance with the distribution of the cylinders of the associated internal combustion engine to be suppled by the fuel injection pump.

Figure 3:
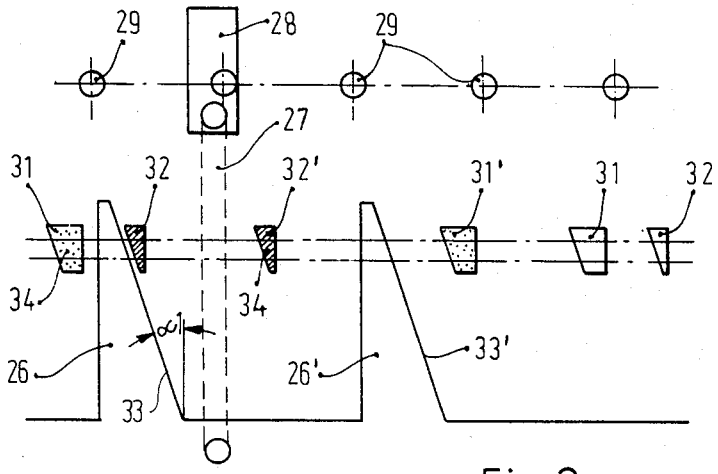
FIG. 3 shows the modification of the distributor with respect to its control grooves and the openings controlled thereby.

Fuel inflow openings 31 and fuel relief openings 32 are provided in the range of movement of the control groove 26 in one radial plane; in their disposition and distribution, these openings 31 and 32 are shown for the modification according to FIG. 3. In this exemplary embodiment, two control grooves 26 and 26' are provided, for example, and their at least one control edge 33, 33' extends at an angle of $\alpha_1$ obliquely with respect to the axis of the distributor. The limiting edges 34 of the fuel inflow opening 31 and fuel relief opening 32 which are associated in the movement direction of the control grooves with the control edges 33, 33' are correspondingly embodied as edges extending obliquely and parallel to the control edge 33. One fuel relief opening and one fuel inflow opening are opened up at a time, in alternation, by means of the control grooves 26, 26'. In the exemplary embodiment of a distributor injection pump for supplying four cylinders, two fuel inflow openings 31 and two fuel relief openings 32 are provided here.

From the fuel inflow opening 31, a fuel conduit 35 in the housing 1 leads away toward the pressure side of a fuel supply pump 36, which pumps fuel from a fuel supply container 37 to the fuel injection pump. The supply pressure of the pump is kept constant with a pressure control valve 38 in a fuel return line. A magnetic valve 39 is connected with the fuel conduit 35 and is controlled by a control device 40, not shown in detail, in accordance with operating parameters. Instead of the magnetic valve, naturally other rapid-switching electromechanical closing means could be used, such as piezo valves. A fuel reservoir 41 is connected to the line 35 between the magnetic valve 39 and the fuel supply pump 36, having a variable volume and being capable of storing fuel at a constant pressure, as a result of which the supply line pressure for the fuel supply pump can be kept low.

A fuel conduit 42 leads away from the fuel relief openings 32, carrying away the outflowing fuel in a pressure-relieved manner. A movable part 44 of a transducer 45 which protrudes out of the housing 1 is secured to the end of the distributor 2, coupled with the drive shaft 7, and moves along with the distributor in all its movements. The transducer 45 further comprises a stationary part 46, which, if for instance an inductive transducer is used, contains the induction coil and detects the travel past it of a control edge 47 of movable part 44 by means of a control pulse. This control plus is delivered to the control device 40.

Figure 2:
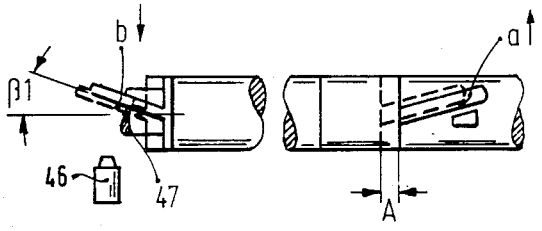
FIG. 2 separately shows a portion of the distributor of the first exemplary embodiment.

The movable part 44 of the transducer 45, in the exemplary embodiment of FIG. 2, is a narrow strip of sheet metal, the control edge 47 of which extends at an angle of $\beta_1$ to the longitudinal axis of the distributor. The angle $\beta_1$ is inclined in the opposite direction from the angle $\alpha_1$.

The operation of the fuel injection pump of FIG. 1 will now be described, referring to FIGS. 3 and 4. Beginning with a fixed axial position of the distributor 2, the distributor is now set into rotation by the drive shaft. In synchronism therewith, the cam ring 24 is then moved and the cam path 23 is followed by the guide rollers 21. The pump pistons 14 execute a reciprocating movement, and during their movement inward they pump fuel located in the pump work chamber 15 via the logitudinal conduit 27 and the distributor groove 28 into one of the injection lines 29. The injection is then interrupted, however, whenever the control edge 33 or 33' of the control groove 26 or 26' has opened one of the relief openings 32. The fuel pumped subsequently to the distributor then flows out via the fuel conduit 42.

The supply of the pump work chamber 15 is effected via the fuel inflow opening 31. At top dead center at the latest, that is, before the reversal of the stroke of the pump pistons or the guide rollers 21, one of the fuel inflow openings 31 is opened by means of one of the control grooves. Fuel can flow through the then-opened magnetic valve 29 via the control groove into the pump work chamber 15, so that the pump pistons 14 are displaced under the influence of centrifugal force as the tappet cups 19 move outward. With the closure of the magnetic valve 39, this delivery of fuel is stopped, so that the pump pistons 14 stop at a terminal position corresponding to this instant. The tappet cups, however, can continue to follow the cam path 23 as far as the lowest point thereof. From the time it attains the lowest point, then, however, the control groove has once again traveled past the fuel inflow opening 31, so that the pump work chamber is closed off completely, independently of the switching position of the magnetic valve 39. After the tappet cups reverse their movement they strike the pump pistons to initiate the supply stroke; the position of the pump pistons, with respect to the cam elevation, determines the instant of injection.

Figure 4A:
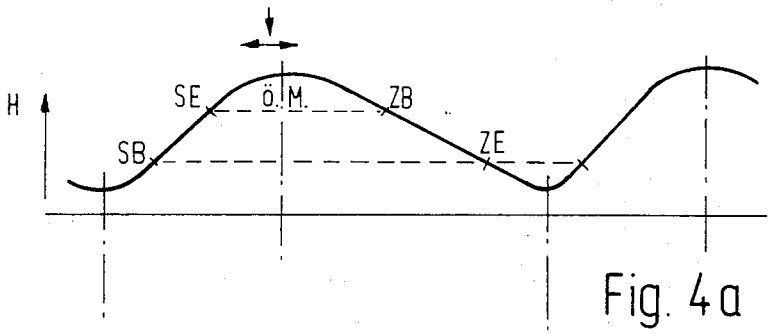
FIG. 4*a* shows the course of the cam elevation curve with associated points for the injection cycle and the intake cycle.
Figure 4B:
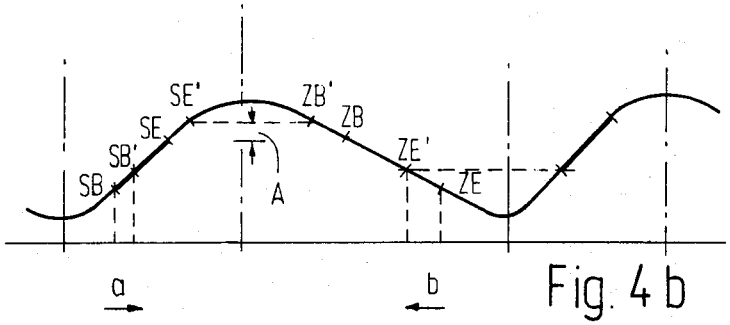
FIG. 4*b* shows the course of the cam elevation according to FIG. 4*a* with various injection times.

This course of events is shown in FIG. 4*a*. Also shown in this figure is the feature that the cam elevation edge during the pumping stoke of the pump pistons is embodied substantially steeper than the edge serving to effect the intake stroke of the pump pistons. The amount of the inclinations differs by a factor K. The symbol SB indicates the injection onset and SE indicates the end of injection. On the intake side, the onset of metering is indicated at ZB and the end of metering is indicated at ZE. It is apparent that the pump work chamber is scavenged with fuel in the period between SE and ZB, in such a manner that equalized pressure conditions prevail here. This can be accomplished in particular by providing that the magnetic valve 39 is already opened at top dead center of the cam elevation curve, at ÖM. Since the quantity of fuel to be metered is supposed to be determined via the opening tie of the magnetic valve, however, the control device controlling the magnetic valve is supplied with a signal which sets the zero point for the elapse of a metering time up to ZE. This zero point is the onset of metering ZB and, at constant conditions, is located at the same cam height as the point SE. This signal for the metering onset is received by the control device from the transducer 45. By means of the flatter course of the cam edge controlling the intake stroke of the pump pistons, the injection quantity can be controlled rather precisely by fixing the degrees of rotational angles. From the drawing, it is clear that in order to keep the injection onset constant, the end of metering must be located at the same stroke height as the injection onset. It is also clear, however, that as a result of a variation of the injection onset, the point ZB must also vary together with the point SE if the fuel injection quantity is to be kept contant. These relationships are illustrated in FIG. 4*b*. Upon a variation of the injection onset, the distributor 2 is displaced longitudinally by a corresponding control of the magnet winding 10. If as shown in FIG. 2, the distributor is displaced toward the left, by the amount A, then the opening point of, for instance, the fuel relief opening 32 is shifted toward "late" by the amount a. The end of injection SE' here shifts by the amount a toward the right and simultaneously the rising edge moves upward corresponding to the stroke A. The injection onset SB' is thus shifted to "late". Now, however, if the fuel injection quantity is to remain constant, the metering onset ZB' must be shifted toward "early" by the same stroke amount A, because of the different edge inclination corresponding to the amount b. The magnetic valve 39 can then also close earlier by the corresponding amount, at point ZE', which in terms of the cam stroke corresponds to the injection onset SB'. As a result of the embodiment according to the invention, this requirement for shifting the metering onset toward "early" upon a shift of the injection onset toward "late" is attained by means of the opposite inclination of the control edge 47 of the movable transducer part 44. It can be seen from FIG. 2 that the control point is shifted forward, upon a leftward displacement of the distributor 2, by the amount b.

By the appropriate embodiment of the control edge 47, other dynamic conditions can also be taken into consideration. The disposition has the substantial advantage that the movable part 44 is capable of travel paths of relatively wide compass, so that even at small variations in the angle of the injection onset, relatively large travel distances can be covered. High resolution on the part of the transducer is thereby attained.

Figure 6:
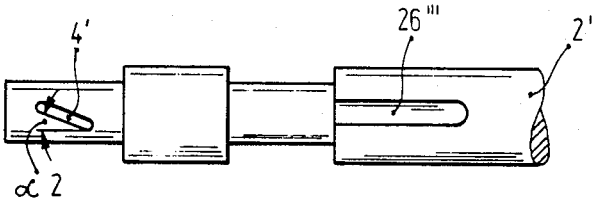
FIG. 6 shows the coupling portion and the course of the control groove on the distributor according to a third exemplary embodiment.
Figure 7:
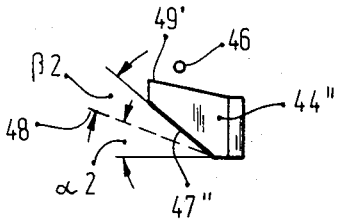
FIG. 7 shows the movable transducer part for an exemplary embodiment according to FIG. 6.

A technical equivalent to the exemplary embodiment of FIG. 1 is shown by the distributor 2' of FIG. 6. There it can be seen that the oblong hole 4' no longer extends parallel to the longitudinal axis of the distributor, but instead is inclined by the angle $\alpha_2$. Instead, the control groove 26''' now extends parallel to the axis of the distributor. With this equivalent embodiment, a varied association of the control groove and the fuel inflow opening 31 or fuel relief opening 32 in terms of rotary position is likewise attained by the displacement of the distributor. However, in this exemplary embodiment the movable transducer part must have a control edge 47', as shown in FIG. 7, which is inclined away from the longitudinal axis of the distributor by the angle $\alpha_2$ plus a corresponding angle $\beta_2$. The control edge 47' has an opposite inclination by the angle $\beta_2$ with respect to the reference line 48 resulting from the rotation of the distributor upon its displacement; the reference line 48 extends at the angle $\alpha_2$ from the longitudinal axis of the distributor. With the angle $\beta_2$, as already mentioned, the lesser inclination of the cam edge controlling the intake stroke of the pump pistons is taken into consideration.

It is also shown in FIG. 7 that here the movable part 44'' also has a second control edge 49', which here is inclined by the angle $\alpha_2$ to the longitudinal axis of the distributor 2'. This second control edge 49' likewise cooperates with the stationary part 46 of the transducer 45, and as it overtakes the stationary part 46 it releases a pulse which is a standard for top dead center, or for the reference position of the drive shaft 7. With this second control edge together with the first control edge 47'', the amount of the injection adjustment can be ascertained precisely and a desired angle for injection onset can be established.

Figure 5:
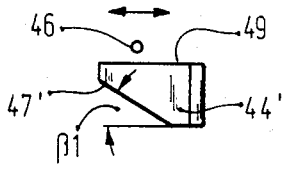
FIG. 5 is a plan view on the movable part of a transducer according to a second exemplary embodiment.

In the exemplary embodiment of FIG. 1, the second control edge 49' of a corresponding movable transducer part 44', as seen in FIG. 5, is realized parallel to the axis of the distributor 2, since the distributor 2 during its longitudinal movement does not execute any rotational movement relative to the drive shaft 7. With this exemplary embodiment as well, not only can the control of metering be attained via the magnetic valve 39, but at the same time the actual value for the injection adjustment can also be ascertained precisely and a set-point injection onset valve can be established with the regulating device 40.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump having at least one work chamber defined by a pump piston, which chamber communicates continuously with a distributor opening on a distributor rotating in a bore and coupled with a drive shaft and by means of this distributor opening the work chamber can upon the rotation of the distributor, be made to communicate in sequence during a supply stroke of the pump piston with supply lines disposed about the circumference of the bore and which leads to the fuel injection location, and the pump work chamber furthermore communicates continuously with a control groove in a jacket face of the distributor, said control groove being disposed obliquely with respect to the axis of said distributor cooperating with at least one opening discharging into the bore of a fuel conduit and communicates with a fuel supply source, and the distributor is axially displaceable with respect to said drive shaft while maintaining its rotational angle position and thus the rotational position of the control groove is variable with respect to the opening of the fuel conduit and of the drive shaft wherein the fuel conduit can be made to communicate via an electrically actuatable switching valve with the fuel supply source, and the switching valve is controllable during the intake stroke of the pump piston by an electrical control device in such a manner that the switching valve is at the latest opened after the opening, in its function as the metering opening of the fuel conduit, has been opened by the control groove and the switching valve is closed at a time that the control groove has still opened the opening of the fuel conduit, and that furthermore a transducer is associated with the distributor, said transducer has a movable part connected with the distributor and also has a stationary part, the stationary part being a receiver and the movable part having a control edge for triggering a pulse on the part of the receiver, an inclination $B_1$ of the control edge being opposite in the displacement direction of the distributor from an inclination $\alpha_1$ of the control groove, which transducer ascertains an axial position of the distributor as a signal for the rotational position of the control groove with respect to the opening of the fuel conduit, which signal serves as signal for the onset of the metering of the fuel to be injected which is controlled by a control device via the switching valve.

2. A fuel injection pump as defined by claim 1, in which the control groove is disposed obliquely with respect to the axis of the distributor, and the distributor is displaceable with respect to said drive shaft while maintaining its rotational angle position.

3. A fuel injection pump as defined by claim 1, in which said control groove is disposed parallel to the axis of the distributor, and the distributor is rotatable with respect to said drive shaft upon its displacement, by means of an oblique guide at its coupling point with the drive shaft.

4. A fuel injection pump as defined by claim 2, in which the transducer has a movable part connected with the distributor and also has a stationary part, the stationary part being a receiver and the movable part having a control edge triggering a pulse on the part of the receiver, the inclination $\beta_1$ of the control edge being opposite in the displacement direction of the distributor from the inclination $\alpha_1$ of the control groove.

5. A fuel injection pump as defined by claim 3, in which the inclination $\beta_2$ of the control edge being opposite to the inclination $\alpha_2$ of a reference line, which is generated by a point of the control groove with respect to a stationary object by the displacement of the distributor, relative to the axis of the distributor.

6. A fuel injection pump as detined by claim 1, characterized in that the amount of the inclination angle $\beta$ of the oppositely extending control edge of the transducer part differs by a multiplication factor (k) from the amount of the inclination angle $\alpha$, the factor corresponding to the ratio of the stroke variations per rotational angle during the intake stroke of the pump piston on the one hand and on the other during the pumping stroke of the pump piston.

7. A fuel injection pump as defined by claim 5, characterized in that the amount of the inclination angle $\beta$ of the oppositely extending control edge of the transducer part differs by a multiplication factor (k) from the amount of the inclination angle $\alpha$, the factor corresponding to the ratio of the stroke variations per rotational angle during th intake stroke of the pump piston on the one hand and on the other during the pumping stroke of the pump piston.

8. A fuel injection pump as defined by claim 6, in which the other part of the transducer has an additional control edge which triggers a control pulse on the part of the receiver, which control edge extends in the displacement direction of the distributor such that it extends in the same direction as the rotational position of the distributor, resulting upon the displacement of the distributor, relative to the rotational position of the drive shaft.

9. A fuel injection pump as defined by claim 7, in which the other part of the transducer has an additional control edge which triggers a control pulse on the part of the receiver, which control edge extends in the displacement direction of the distributor such that it extends in the same direction as the rotational position of the distributor, resulting upon the displacement of the distributor, relative to the rotational position of the drive shaft.

10. A fuel injection pump as defined by claim 1, in which two control grooves are disposed on the distributor and at the circumference of the bore guiding the distributor, at least one opening serving the purpose of fuel delivery from a conduit connected with the switching valve and one relief opening serving the purpose of carrying fuel away, and each of said openings are controllable in alternation by the two control grooves.

11. A fuel injection pump as defined by claim 1, in which a fuel reservoir serves as a fuel source having a variable volume, which is supplied by a fuel supply pump from a fuel supply.

12. A fuel injection pump as defined by claim 8, wherein the amount of the injection adjustment is ascertained in the control device as an actual value on the basis of any pulses triggered by the two control edges of the movable part.

13. A fuel injection pump as defined by claim 9, wherein the amount of the injection adjustment is ascertained in the control device as an actual value on the basis of any pulses triggered by the two control edges of the movable part.

14. A fuel injection pump as defined by claim 12, in which the actual value of the injection adjustment is compared in a comparison device with a set-point value and an adjusting device is controlled in accordance with the result of comparison in order to displace the distributor.

15. A fuel injection pump as defined by claim 13, in which the actual value of the injection adjustment is compared in a comparison device with a set-point value and an adjusting device is controlled in accordance with the result of comparison in order to displace the distributor.

* * * * *